United States Patent [19]

Montgomery

[11] 4,403,624

[45] Sep. 13, 1983

[54] COSMETIC APPLICATOR AND CONTAINER SYSTEM

[76] Inventor: Robin M. Montgomery, 3819 Hayvenhurst Ave., Encino, Calif. 91436

[21] Appl. No.: 305,697

[22] Filed: Sep. 25, 1981

[51] Int. Cl.[3] ..... A45D 40/26; A46B 11/00

[52] U.S. Cl. ..... 132/88.7; 132/85; 401/122; 401/129; D28/7

[58] Field of Search ..... 132/79 A, 88.7, 85, 132/112, 114, DIG. 3; 401/122, 129; 15/DIG. 5, 159 A, 187; D28/7; D4/25

[56] References Cited

U.S. PATENT DOCUMENTS 2,279,355 4/1942 Wilensky ..... 15/10

2,990,834 7/1961 Amen ..... 132/85

3,471,244 10/1969 Melocchi ..... 401/122

3,896,823 7/1975 Spatz ..... 132/85

*Primary Examiner*—Gene Mancene

*Assistant Examiner*—John Weiss

*Attorney, Agent, or Firm*—Harlan P. Huebner

[57] ABSTRACT

An applicator system for the application of cosmetics wherein there is a container including a dual wiper mechanism mounted therein, and an applicator and handle. The applicator includes a plurality of flexible spines which contain the cosmetic and upon removal from the container will engage the dual wipers successively and remove the excess cosmetic. The spines may be arranged in various patterns to achieve a single instrument application of the cosmetic.

6 Claims, 13 Drawing Figures

FIG. 1.
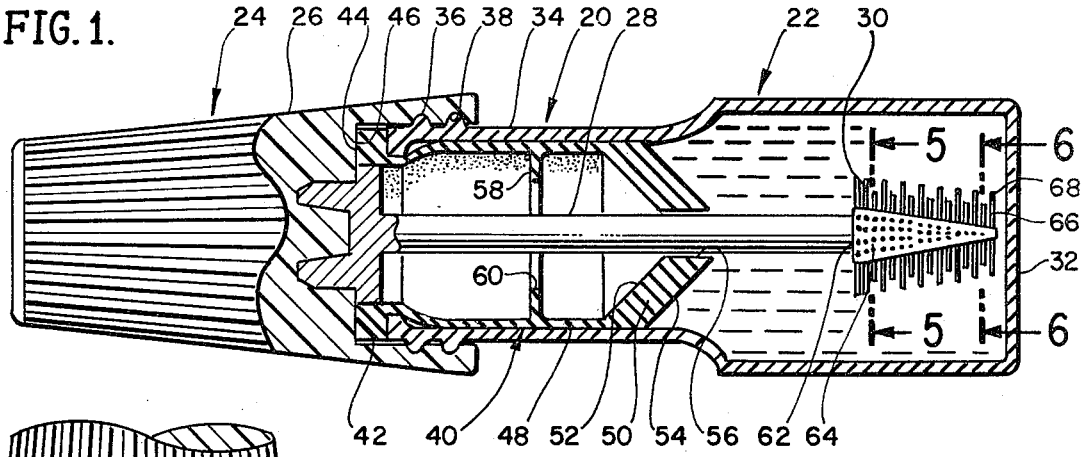
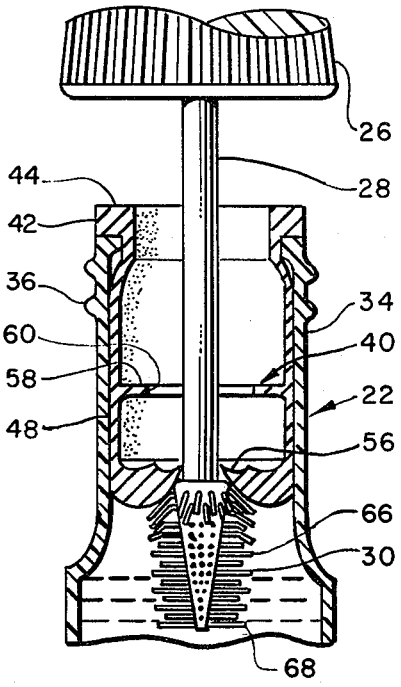
FIG. 2.
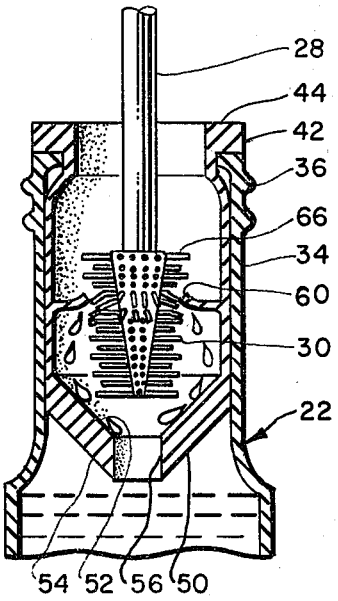
FIG. 3.
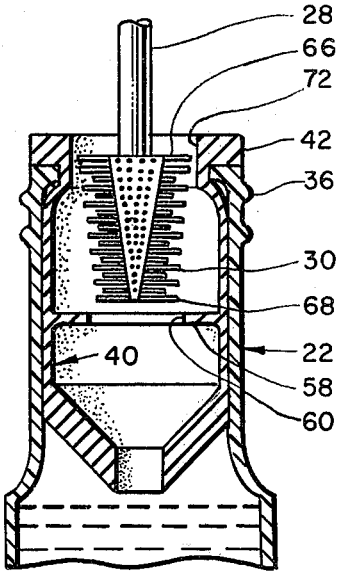
FIG. 4.
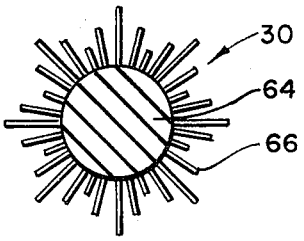
FIG. 5.
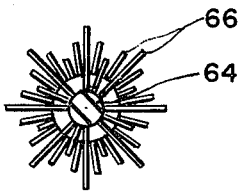
FIG. 6.
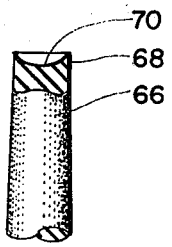
FIG. 7.

FIG. 8.
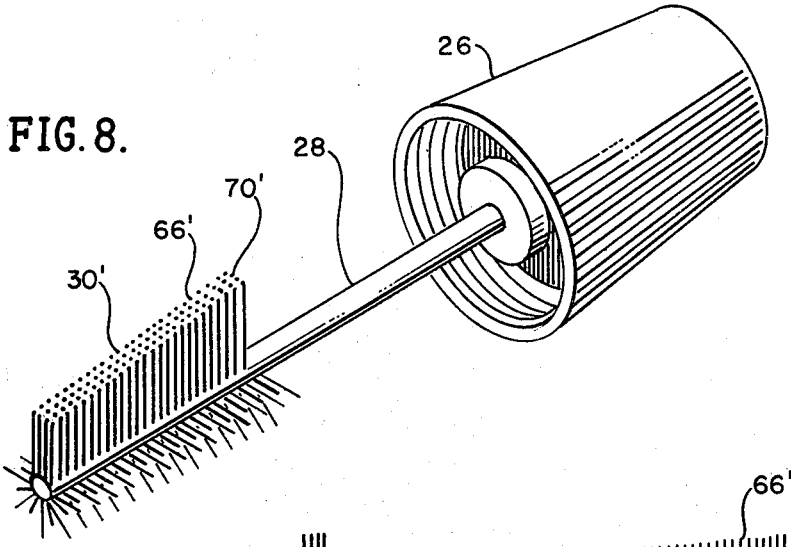
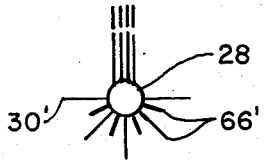
FIG. 10.
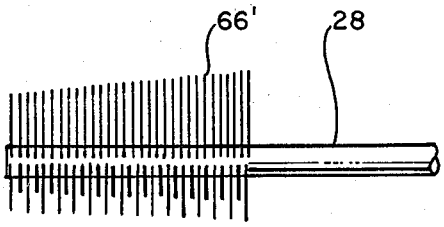
FIG. 9.
FIG. 11.
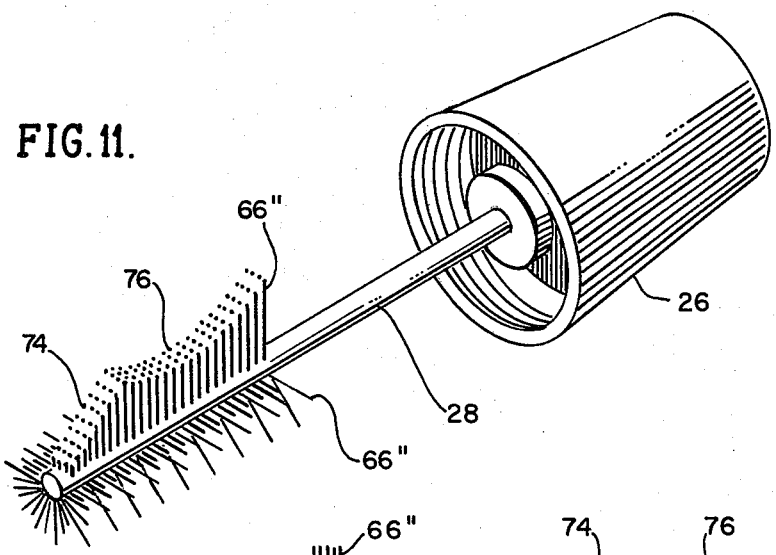
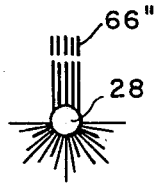
FIG. 13.
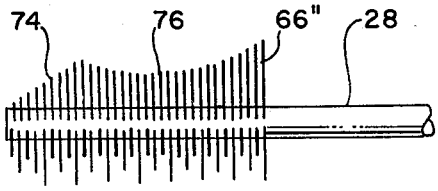
FIG. 12.

COSMETIC APPLICATOR AND CONTAINER SYSTEM

BACKGROUND OF THE INVENTION

The present invention relates to the application of cosmetics, and more particularly to applicator devices for applying cosmetics, such as mascara, to the eye lashes. In the prior art applicator devices such as found in my U.S. Pat. Nos. 3,763,870 or 3,921,650 the devices that have been used for the application of cosmetics to eye lashes have required either stiff single elements or two elements. In the case of the first patent a single apparatus in the form of a stiff comb to apply the mascara is described. The inflexibility of the teeth of the comb requires the use of a brush in order to separate the lashes once the mascara is applied. With regard to may other and later patent while there has been a combination of the comb and brush it has required the use of one side of the implement and then turning it over to complete the finished approach to the application of the mascara.

SUMMARY OF THE INVENTION

It is an object of the present invention to provide an improved cosmetic applicator for the applying of mascara and the like.

It is another object of the present invention to provide an applicator for applying mascara and the like to eye lashes, the applicator including a brush in the form of a plurality of varying length flexible spines.

It is a further object of the present invention to provide an applicator, as described in the previous paragraph, for applying mascara, including a container having a wiper mechanism for removing undesirable amounts of mascara from the brush portion sequentially as the applicator is removed from the container. After withdrawing the applicator from the container, and through the wiper, the brush portion may then be applied to the lashes, which will be generally combed through the eye lashes to evenly apply the mascara as well as separating the lashes if necessary and creating the curling effect thereto. With the use of flexible spines it can be seen that this will create a softness and only slight resistance as the applicator is rotated through the lashes in order to achieve the separation of the lashes as well as the coating thereof and removal of excess mascara.

It is further object of the invention to provide a concave tip in each of the respective spines of the applicator to act as reservoir to retain excess mascara so that it can be used as the applicator is being rotated through each of the eye lashes and does selectively apply additional mascara when the mascara is wiped from the sides of each of the spines.

Further objects and advantages of the invention may be brought out in the following part of the specification wherein small details have been described for the completeness of disclosure, without intending to limit the scope of the invention which is setforth in the appended claims.

BRIEF DESCRIPTION OF THE INVENTION

Referring to the accompanying drawings which are for illustrative purposes:

FIG. 1, is a side elevation sectional view of the container, the wiper mechanism, and the applicator;

FIGS. 2, 3 and 4 are cross-sectional view of the neck portion of the container with the wiper mechanism and the applicator means being removed from the container and shown in three positions;

FIG. 5, is a cross-sectional view taken on line 5—5 of FIG. 1;

FIG. 6, is a cross-sectional view taken on line 6—6 of FIG. 1;

FIG. 7, is an enlarged detailed view of the concave portion at the end of one of the spines of the applicator;

FIG. 8, is a perspective view of a modified form of the brush portion of the applicator wherein the spines are in tapered position and the brush portion is generally arcuate at the bottom of the shaft with the upper portion extending vertically from the shaft;

FIG. 9, is a side elevational view of the modification as illustrated in FIG. 8;

FIG. 10, is a front end view of the modified applicator of FIG. 8;

FIG. 11, is a further modification of the brush structure of the applicator;

FIG. 12, is a side elevational view of the modification of FIG. 11; and

FIG. 13, is an end view of the applicator of FIG. 11.

DETAILED DESCRIPTION OF THE PREFERRED EMBODIMENTS

There is illustrated in FIG. 1 a cosmetic system, generally designated 20, including a container generally designated 22 and an applicator generally designated 24. The applicator 24 is comprised of a handle portion 26, and extending therefrom and conventionally secured thereto is a rod 28 having on its end an applicator brush portion 30.

The container 22, as illustrated in FIGS. 1 through 4, is hollow, and preferably of cylindrical shape having a closed end 32 and an opened end having an annular neck 34. The neck 34 is provided with external threads 36 which are engageable with internal threads 38 on the handle 26 when it is secured on the container 22 as, shown in FIG. 1.

Secured within the neck 34 is a resilient and flexible rubber sealing and wiping means, generally designated 40. The means 40 is snuggly and sealingly secured to the neck structure 34. At the outer end of the sealing means 40, overlapping the neck end 34 of the container 22, is an angular flange 42 forming a seal at the neck at 44 and on the inner annular surface 46 of the handle 26 when it is secured on the container, as best seen in FIG. 1.

Extending axially inwardly from the flange 42 is a cylindrical portion 48 of wiper 40 which is elongated and terminates in a frusto-conical shaped first wiper element 50 having parallel inner and outer walls 52 and 54 respectfully. The walls 52, 54 include a relatively small, centrally positioned opening 56 extending therethrough as shown in FIGS. 1 and 3, which are adapted to be in complete wiping encirclement of the annular rod 28.

The cylindrical portion 48 of the means 40 includes, intermediate the first wiper portion 50 and the annular flange 42, a flexible wall 58 or second wiper portion which includes an opening 60 extending therethrough. The opening 60 is larger than the opening 56, yet smaller than the widest diameter of the applicator brush portion 30.

At the end of 62 of the rod 28 there is fitted thereto a brush base 64 which is preferably tapered as seen in the drawings. The brush base 64 may be made of latex or other plastic materials and secured thereto and extending therefrom are a plurality of teeth or spines 66. The respective teeth or spines 66 are of different lengths. The purpose of this is to assure complete contact with each of the eye lashes as the brush 30 is being combined through the lashes. In addition each of the teeth or spines 66 are preferably of latex or relatively resilient and flexible material whereby they may be deformed individually and independently of each other as they are either being wiped upon removal from the container 22 or moving through and between the respective lashes of the user.

Each of the ends 68 of spines 66 are concaved as shown as 70 which concavity will act as a reservoir for mascara. Thus each tooth or spine 66 will be able to retain a small amount of mascara that can be used and added to the application as the respective teeth 66 are combed through the eye lashes.

As can be seen from the drawings also the teeth 66 are positioned annularly around the brush base 64 to form a complete annular brush 30 being completely surrounded with the teeth 66. As best seen in FIGS. 5 and 6, it is possible then for the person utilizing the cosmetic system to grasp the handle 26 and with the mascara appropriately remaining on the teeth or spines 66 and in the respective reservoirs or cavities 70 rotate the brush portion 30. This will ensure an even distribution of mascara on the lash and it will also afford an appropriate separation of the lashes by means of the respective flexible teeth of the brush portion 30 of the handle 26 interfitting between individual lashes.

FIGS. 1 through 4 show the steps by which the cosmetic system 20 may be utilized and are described in the following manner:

The applicator handle 26 is unscrewed from the neck 34 of the container 22 and is then withdrawn from the container by pulling the rod 28 and applicator brush portion 30 through the first wiper opening 56 of the wiper such as shown in FIG. 2. It will be noted that the opening 56 is generally the same diameter as rod 26 so there is a great deformity of flexing of the teeth 66 as the applicator is withdrawn. This removes considerable excess mascara from the brush and virtually all from the rod.

As the applicator 26 is further removed or pulled upwardly from the container 22 the applicator brush portion 30 and particularly the teeth 66 will be drawn through the opening 60 of the annular wall or second wiper 58. This wiping will be less severe than in that of FIG. 2 because the angular opening 60 is larger and yet slightly smaller than the widest diameter of the brush portion and extending spines 66. This is best illustrated in FIG. 3. Finally, as the rod 28 moves outwardly and the applicator brush portion 30 moves with it it will come to the flange section 42 wherein the angular opening 72 is slightly larger than the widest diameter of the brush portion and expending spines 66, for easy removal.

It should be noted that the reason for the double wiping effect of the applicator is that the first wiping as shown in FIG. 2, removes the majority of the mascara. The second wiping because the opening 60 is relatively large will act to prevent splattering of the mascara on to the hands of the user as it is being withdrawn and to finish the removal of excess mascara.

FIGS. 8 through 12 of the drawings illustrate two modified forms of the applicator brush portion 30. In FIGS. 8 through 10 there is a modified brush portion 30' which in this case includes teeth 66' making up the brush portion directly affixed to the rod 28 of handle 26. It should be noted that preferably the bottom portion is arcuate and semicircular. That is best seen in FIGS. 9 and 10. The bottom brush portion 30' is a half circle which extends horizontal around the bottom half. Again in this particular modification the respective teeth or spines 66' are of varying length in order to assure complete coverage of each of the lashes. The rest of the modification as shown in FIGS. 8 through 10 include vertically extending teeth 66' which have an outer face which is preferably tapered, as best seen in FIGS. 8 and 9. These particular teeth 66' are parallel to one another and each of them are on the same plane even though there is a tapering with the length varying from front to rear for each of the teeth 66'. In effect this modification, as shown in FIG. 8, would resemble that of the teeth of a toothbrush. The purpose, of course, of tapering of the upper vertical section is that this may assist and be useful in an overall smoothing of the eye lashes once the bottom semicircular brush portion has been used to apply the mascara and coat the respective lashes. As can be seen when there are teeth 66' of varying lengths and thickness it is possible that there is no smooth or uniform plane for each of the lashes of the eye lashes and therefore the upper vertical portion can be used to achieve a smoothing and alignment of the lashes. Again each of the teeth 66' may include a cavity 70' to act as a reservoir for maintaining the mascara.

FIGS. 11 through 13 illustrate still another form of applicator wherein the modification, over FIG. 8 and the basic invention, is that again there is a semicircular of half circular brush portion here again the teeth 66'' are of varying thickness as seen in the figures. The modification over FIG. 8 resides in the fact that the vertically extending teeth 66'' are curved at the top and also are tapered downwardly in the front to the point of the brush as can best be seen in FIG. 12. This top curvature 76 of the teeth 66'' will conform to the curvature of eyes and lashes which extend outwardly from the eye lids. The tapered end 74 of the upper portions may also be used to achieve the finer smoothing and alignment of the lashes as with the curved portion 76.

After the mascara has been applied, the applicator brush portion 30 is reinserted into the container 32 through the wiper means causing it to assume a position shown in FIG. 1 of the drawings. The handle 26 is then rotated so that the interior threads 38 of the handle will engage the exterior threads 36 of the container to tighten it up on the neck of the container. The tightening provides a seal between the flange 44 and handle surface 46. Further, the flange 44 functions like a washer to prevent mascara leakage from the container 22.

The cosmetic container 22 and the parts thereof other than the spines and the wipers and the applicator brush portion 30 are preferably formed of plastic by a relatively inexpensive molding process so that the entire cosmetic system may be discarded after the mascara contained therein has been exhausted.

As is understood from the foregoing, a unique inexpensive and efficient mascara applicator system has been provided in the present invention.

The invention and its intended advantages will be understood from the foregoing description and it will be apparent that various changes may be made in the form construction and arrangement of the parts of the invention without departing from the spirit and scope thereof or sacrificing the material advantages, the arrangement herein before described being merely by way of examples and I do not wish to be restricted to the specific form shown, used for mentioned except as defined in the accompanying claims, wherein various portions have been separated for clarity of reading not for emphasis.

I claim:

1. In a cosmetic system for use in the application of mascara to eye lashes, a container for holding mascara and having an opening;

an applicator including a handle portion, a rod portion having a longitudinal axis and an applicator brush portion;

said applicator brush portion and said rod being removably inserted in said container through said opening to immerse said applicator brush portion in mascara;

wiper means mounted on said container and extending thereinto from said opening for wiping said applicator as it is withdrawn from said container;

the improvement comprising:

said applicator brush portion includes an annular base portion and a plurality of spines projecting outwardly from said base, said spines being resilient, of varying lengths, independent one from the other and each spine being circular in cross section;

said wiper means includes a cylindrical portion interfitted within said container having a flange portion at one end for engagement with the opening of said container and a frusto-conical shaped end portion of a resilient elastic and flexible material converging inwardly of said container forming an opposite end wall and an opening extending therethrough forming a first wiper portion therewith and intermediate said flange portion of said frusto-conical shaped end portion a wall of a resilient elastic and flexible material and an opening extending therethrough forming a second wiper portion therewith; and each of said openings in said wiper means being of a diameter to stretchable engage said applicator brush portion as said applicator is withdrawn from said container and one of said openings is of a diameter to also circumferentially engage said rod whereby excessive mascara on said brush portion and said rod is removed.

2. The invention according to claim 1 in which:

the ends of each of said spines are concave and from a reservoir to retain mascara for application.

3. The invention according to claim 1 in which:

the opening of said first wiper means is of a diameter complimentary with said rod and upon withdrawal of said rod from said container will remove mascara from said rod, and yet said wiper is stretchable and distortable to allow removal of said applicator brush portion and initial removal of mascara therefrom, and wherein said opening of said second wiper means is of a diameter greater than said first opening yet less than the widest diameter of said applicator brush portion whereby upon further withdrawal of said rod and applicator the opening of said second wiper means is stretched and additional mascara may be removed from at least a portion of said brush and exterior splattering is prevented.

4. The invention according to claim 1 in which:

the spines of said brush portion are arranged to form two separate brush elements projecting from said base.

5. The invention according to claim 4 in which:

one of said brush elements include spines extending from a portion of said brush base normal to the axis of said rod partially around the circumference of said rod in a semicircular pattern, and the other of said brush elements spaced circumferentially around said base from said first named brush element which includes a second set of spines extending from a portion of said brush base normal to the axis of said rod and said spines project outwardly parallel one with the other.

6. An applicator for applying mascara and immersible in a container carrying fluid cosmetic and being selectively wiped by at least two wipers in the opening of said container upon removal therefore, said applicator including:

a handle portion, a rod portion having a longitudinal axis and an applicator brush portion, said applicator brush portion includes an annular base portion and a plurality of spines projecting outwardly from said base; and said spines of said brush portion are resilient of varying lengths, independent one from the other and each spine is circular in cross section and the ends of each of said spines are concave to form a reservoir to retain mascara for application.

* * * * *